United States Patent [19]

Jungles

[11] 4,342,402

[45] Aug. 3, 1982

[54] REFUSE CONTAINER COVER

[75] Inventor: Donald S. Jungles, Lockport, Ill.

[73] Assignee: Dymar Industries, Inc., Lockport, Ill.

[21] Appl. No.: 263,414

[22] Filed: May 14, 1981

[51] Int. Cl.[3] ..... B65D 43/14; B65D 51/04

[52] U.S. Cl. ..... 220/343; 220/1 T

[58] Field of Search ..... 220/1 T, 334, 343

[56] References Cited

U.S. PATENT DOCUMENTS

| | | | |
|---|---|---|---|
| 4,151,928 | 5/1979 | Fagdiano et al. | 220/1 T |
| 4,158,424 | 6/1979 | Carmack | 220/343 |
| 4,199,075 | 4/1980 | Rohrer | 220/1 T |

OTHER PUBLICATIONS

Brochure of Dymar Industries, Inc., Entitled "Planning Builds the Best".

*Primary Examiner*—George T. Hall

*Attorney, Agent, or Firm*—Hill , Van Santen, Steadman, Chiara & Simpson

[57] ABSTRACT

A light-weight, one piece maintenance free, weather-resistant, stiff, warp and sag-proof planar molded plastics material cover or lid for containers has embossed portions defining hinge structure along the rear edge thereof, spaced transverse ribs across the width thereof and a longitudinal rib adjacent the front edge thereof merged into the transverse ribs. A peripheral lip is also formed around at least the front and sides. The lid or cover is substantially uniform in thickness, the embossed ribs are preferably U-shaped in cross section, and the embossed hinged structure has apertures forming bearings for a hinge rod.

12 Claims, 10 Drawing Figures

FIG. 6
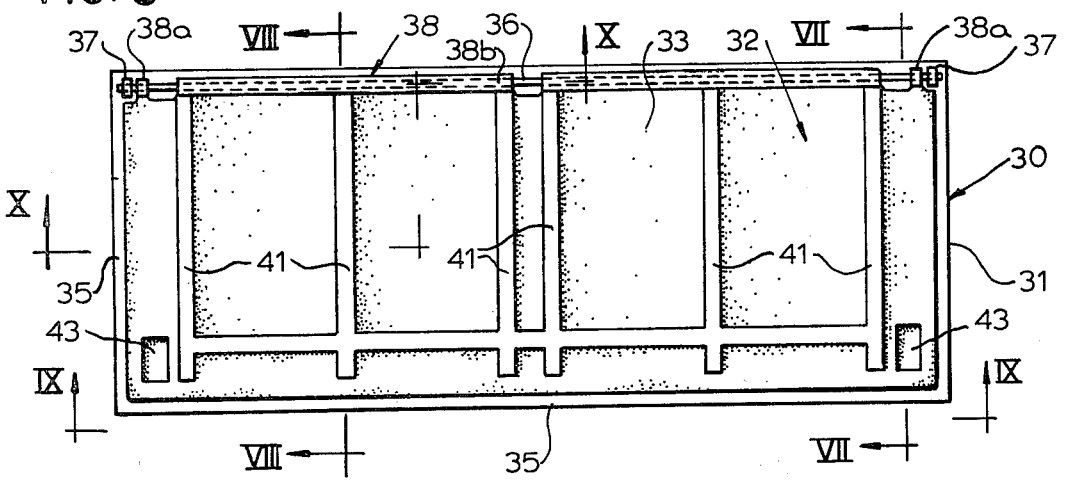
FIG. 7
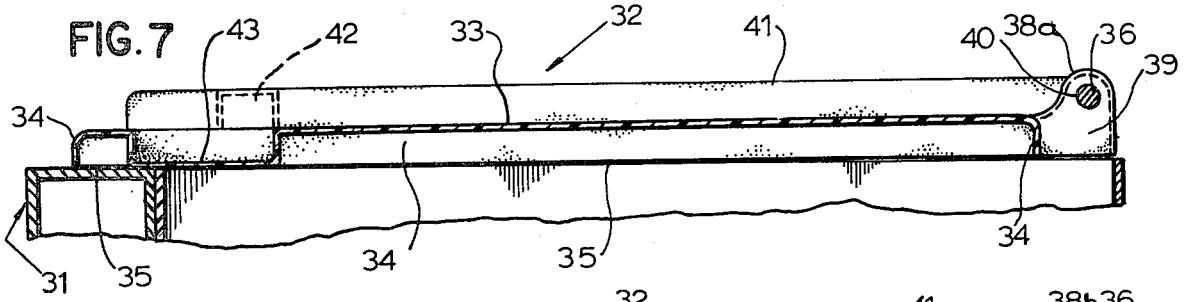
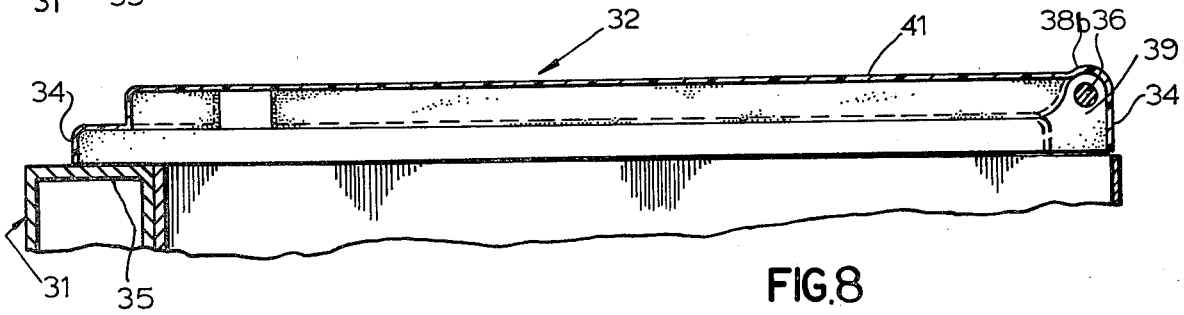
FIG. 8
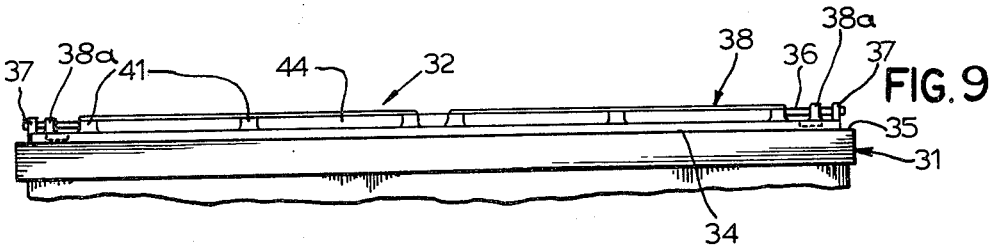
FIG. 9
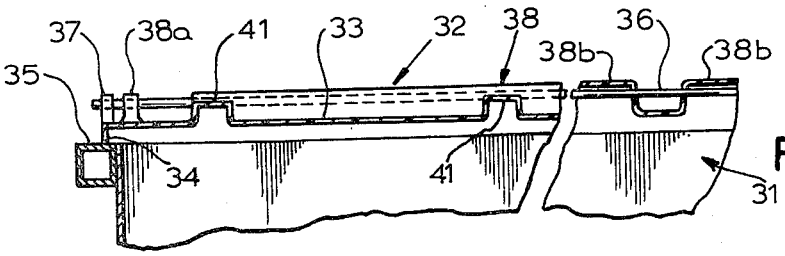
FIG. 10

REFUSE CONTAINER COVER

BACKGROUND OF THE INVENTION

1. Field of the Invention

This invention relates to the art of molded plastics material planar lids or covers with embossments which provide functional structures and reinforcing ribs which will resist distortion without requiring thickened areas and more specifically the invention deals with tough warp resisting planar molded plastic lids or covers for refuse containers having transverse and longitudinal embossed ribs maintaining a flat planar shape through a wide temperature range and under severe use conditions.

2. Description of the Prior Art

Lids or covers for refuse containers especially of the industrial type which are roughly handled by refuse trucks have heretofore been made of heavy guage metal or sheet metal secured to a rigid frame. Such constructions are expensive, heavy, and noisy in use. Attempts to provide lighter molded plastic material lids or covers have not been satisfactory because of breakage and warpage and inability to withstand wide temperature ranges. It would therefore be an improvement in the art to provide a light weight, quiet operating, tough, warp resisting one piece, planar molded plastics material lids or covers for refuse containers especially of the large industrial and commercial type.

SUMMARY OF THE INVENTION

This invention now provides light-weight, one piece, planar molded plastic material lids or covers for large size industrial and commercial refuse containers. The lids or covers are preferably molded from relatively inexpensive easily molded polyolefins, preferably cross linked polyethylenes. Satisfactory polyethylene molding compositions are available under the trade name "Marlex" and are supplied by Phillips Chemical Company of Bartlesville, Okla. C.L.-100 and C.L.-50 high density polyethylene formulations are especially useful, because of their stress cracking resistance, impact strength, and resistance to wide variations in atmospheric temperatures and conditions.

The covers have a depending peripheral lip or flange around at least the front and side edges thereof, preferably of the same depth as the ribs. The rear or back edge of the lids or covers have U-shaped portions forming bearings for a hinge rod carried by the container. Embossments provide transverse ribs across the width and a longitudinal rib across the length near the front edge. The lids are thus stiffened and reinforced against bowing or sagging by the lip, the U shape along the rear edge the longitudinal rib adjacent the front edge and the transverse ribs across the width.

The lids or covers of this invention can vary widely in size to span the open tops of refuse containers which may have widths of 3 to 8 feet and lengths of 4 to 10 feet. Thicknesses of from $\frac{1}{8}$ to $\frac{1}{4}$ inches are sufficient and rib embossments and lip depths may vary from depths of $\frac{1}{2}$ to 1 inches.

It is then an object of this invention to provide a relatively thin, light-weight molded plastic planar cover or lid which will hold its true flat shape over a large span under rough service conditions such as exist with commercial or industrial refuse containers and will not be brittle under cold weather conditions or soften under hot weather conditions.

A further object of this invention is to provide a thin light-weight molded plastic lid or cover for refuse containers, which have an integral hinge rod bearing along its rear edge, a dependent peripheral lip or flange around its side and front edges, a plurality of embossed ribs between the front and rear edges, and an embossed longitudinal rib adjacent the front edge.

A specific object of the invention is to provide a thin planar lid or cover for industrial or commercial refuse containers with merged transverse and longitudinal ribs cooperating with a longitudnal hinge bearing to hold the cover in a flat condition under adverse weather temperatures and severe usage.

A specific object of the invention is to provide a thin polyolefin planar lid for refuse containers embossed longitudinally and transversely to resist deformation.

Other and further objects of this invention will become apparent to those skilled in this art from the following detailed description of the annexed sheets of drawings forming part of this specification and illustrating several embodiments of the invention.

ON THE DRAWINGS

FIG. 1 is a perspective view of a refuse container of the commercial or industrial type equipped with a cover or lid according to this invention;

FIG. 2 is a top plan view of the lid or cover and container of FIG. 1;

FIG. 3 is a fragmentary transverse cross-sectional view along the line III—III of FIG. 2;

FIG. 4 is a view similar to FIG. 3 but showing an inverted cover position;

FIG. 5 is a fragmentary cross-sectional view along the line V—V of FIG. 2;

FIG. 6 is a top plan view of a modified lid or cover on the top of a refuse container;

FIG. 7 is a transverse cross-sectional view along the line VII—VII of FIG. 6;

FIG. 8 is a transverse cross-sectional view along the line VIII—VIII of FIG. 6;

FIG. 9 is a front edge elevational view along the line IX—IX of FIG. 6; and FIG. 10 is a fragmentary longitudinal cross-sectional view along the line X—X of FIG. 6.

BRIEF DESCRIPTION OF THE DRAWINGS

The container and lid assembly 10 of FIG. 1 includes a standard type open top commercial or industrial loader type refuse container 11 and a lid 12 of this invention for covering the open top of the container 11. The container 11 may vary widely in shape and size but is generally a steel material rectangular bin with caster wheels 13 and a longitudinal rod 14 extending along the front top edge thereof and projecting beyond the side walls thereof for engagement with the loading arms of a conventional rear load packer refuse truck.

The molded plastics material cover or lid 12 of this invention is sized to span the open top of the container 11 and to rest on the top marginal wall of the container. The cover 12 is essentially a sheet 15 of from $\frac{1}{8}$ to $\frac{1}{4}$ inch in thickness of a polyethylene plastics material molded with a dependent peripheral lip or skirt 16 about $\frac{1}{2}$ to 1 inch high for resting on the front rod 14 of the container along its front edge as shown in FIGS. 2 and 3 and on the side marginal top edge 17 of the container as shown in FIG. 2. The sheet 15 is embossed upwardly along its rear edge in the form of an inverted U 18 with the rear side leg of the U providing the lip or skirt 16 along the rear edge of the sheet. The inverted U-shaped embossment 18 is preferably separated into two narrow portions 18*a* at the side edges of the sheet and two separated longer central portions 18*b*. Each of the separated portions 18*a* and 18*b* have end walls 19 which are drilled to form holes 20 receiving a hinge rod 21 therethrough as best shown in FIG. 5. This hinge rod spans the top rear end of the container 11 and is anchored at its ends in brackets 22 mounted on the top rear corners of the container 11. The arrangement is such that the cover 12 will swing on the rod 21 with the holes 20 providing bearings riding on the rod.

Figure 1:
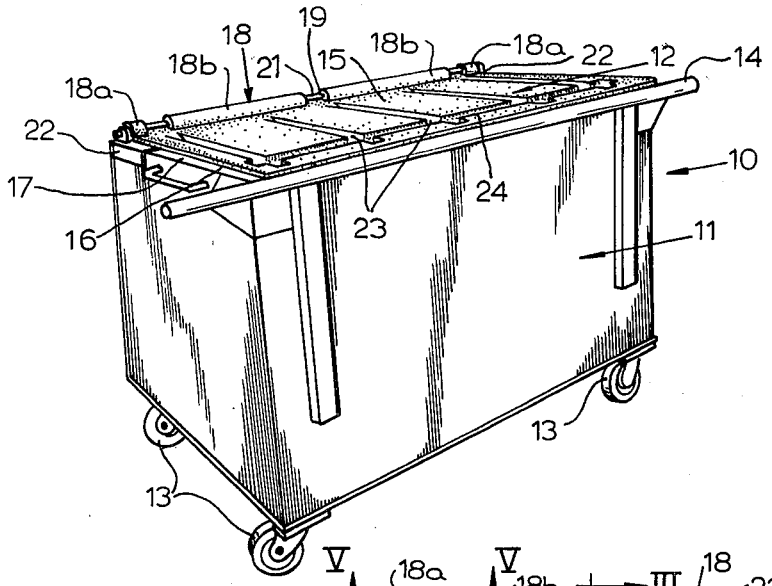
Figure 5:
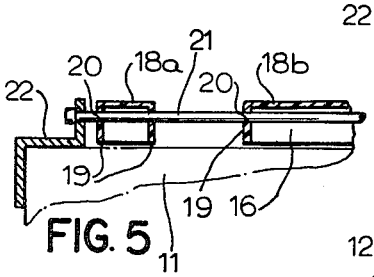

The sheet 15 is also embossed downwardly to form troughs defining spaced parallel depressed ribs 23 extending from adjacent the raised hinge forming embossed portions 18 to closely adjacent the front edge of the sheet just behind the front lip 16.

In addition, according to this invention, the sheet 15 is embossed downwardly to form a trough providing a longitudinal depressed rib 24 adjacent the front end of the sheet and intersecting the front end portions of the ribs 23.

Figure 2:
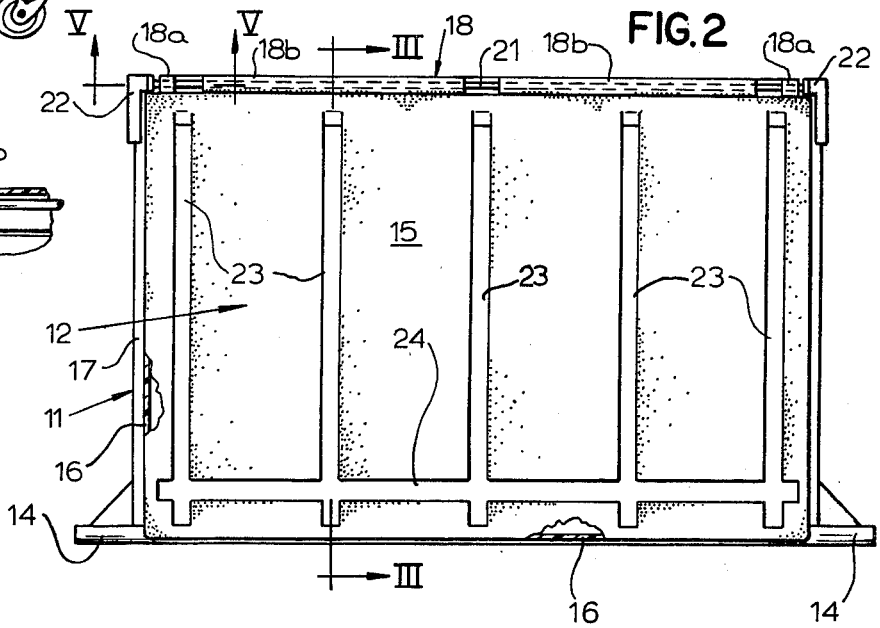
Figure 3:
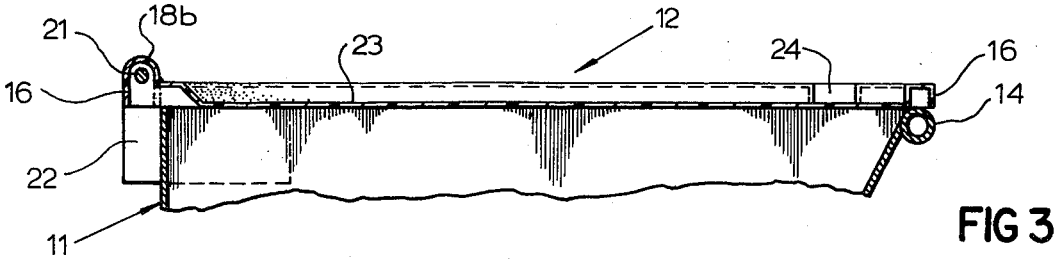

As illustrated in FIGS. 1 and 2, five transverse ribs 23 and one longitudinal rib 24 are provided. The end transverse ribs 23 are closely adjacent the side skirt portion 16 with the three intermediate ribs 23 being equally spaced inwardly from each other and from the end ribs 23. As also shown in FIG. 2, the longitudinal rib 24 intersects the transverse ribs 23 inwardly from the end edges of the transverse ribs.

The embossments forming the ribs 23 and 24 are in the order of ½ to 1 inch deep so that the bottoms of the ribs will be flush with the edges of the skirt 16.

The ribs have tapered side and end walls sloping upwardly and outwardly from flat bottoms.

The transverse and longitudinal ribs 23 and 24 formed by the embossments stiffen the sheet 15 so that it will not sag, twist or deform in any direction from its flat planar free shape even when exposed to extreme weather and load conditions and when roughly handled by a refuse truck picking up the container and dumping the contents thereof. When the container is inverted, of course, the lid or cover is free to swing to an open position releasing the contents of the container.

Figure 4:
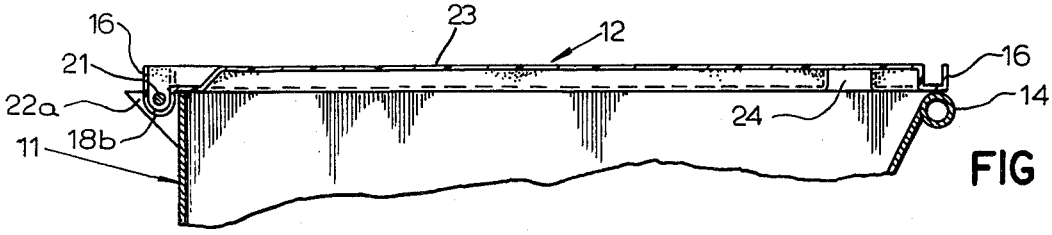

In the arrangement of FIGS. 1 to 3 and 5, the cover or lid is positioned on the container 11 with the sections of the hinge 18 extending upwards and the ribs 23 and 24 being depressed downwardly. However, as shown in FIG. 4, the lid or cover 12 can be inverted with the hinge section 18 extending downwardly and receiving the hinge rod 21 carried in a modified bracket 22*a* projecting from the back corners of the container 11. In this arrangement, of course, the ribs will extend upwardly and the panel sections between the ribs will be depressed. The skirt or lip portion 16 will extend upwardly from the bottom face of the sheet which can rest on the marginal portions of the container.

In the modified assembly 30 of FIGS. 6 to 10 the refuse container 31 has its open top closed by a molded plastic sheet-like cover 32 of this invention. As in the cover 12 of FIGS. 1 to 5, the cover 32 is essentially a flat plastics material sheet 33 of the same thickness range but generally having a longer span to cover a larger container 31. The sheet 33 has a dependent peripheral lip or skirt 34 resting on a flat top marginal edge 35 around the sides and front of the container. A hinge rod 36 extends across the back top edge of the container, being anchored at its ends in brackets 37 and extending through the inverted U-shaped hinge section 38 of the cover. The hinge section 38 like the section 18 of the cover 12 is divided into two narrow end portions 38*a* and two elongated intermediate portions 38*b* all of which have end walls 39 with drilled holes 40 therethrough receiving the rod 36 and providing hinge bearings for the rod.

The sheet 33 has six transversely extending raised embossments providing transverse ribs 41 above the plane of the sheet. The rib pattern 41 is somewhat different from the rib pattern of the cover 12 since as best shown in FIG. 6, the end ribs 41 are closely adjacent the side edges of the cover and two central ribs span the central portion of the cover in closely spaced relation with additional ribs 41 lying between the end ribs and the central ribs. A raised longitudinal embossment provides a raised rib 42 adjacent the front end edges of the transverse ribs and merges into these ribs. This rib pattern is such therefore to have raised embossments on the top face of the sheet 33 and troughs opening downwardly in the bottom face of the sheet with the positioning of these ribs being such as to afford maximum rigidity at locations where needed to prevent warpage or sagging.

An additional pair of embossments are provided at the front side corners of the cover 32 as shown at 43. These embossments form depressed rectangular stiffening blocks at the free corners of the cover.

While the cover 32 is illustrated as having raised embossments providing ribs on the top face of the sheet 33, the cover could be inverted with the ribs on the under-face of the sheet 33.

From the above descriptions it will thus be understood that this invention provides maintenance-free, light-weight high-strength, noiseless, rust-proof, one-piece covers or lids for refuse containers and the like composed of tough polyolefin plastics material and having embossments providing ribs and hinge supports which will resist warpage and sagging under all weather conditions, and provide noiseless opening and closing of refuse containers.

It will be understood that variations and modifications may be effected without departing from the spirit and scope of the novel concepts of this invention.

I claim:

1. In combination with a container having an open top section with hinge rod brackets and a hinge rod at the back edge thereof, a one piece molded plastics material lid for said open section comprising a substantially planar sheet of substantially uniform thickness with a dependent peripheral lip along the front and sides of the sheet, said sheet having U-shaped hinge portions extending along the rear edge thereof with end wall portions having bores adapted to receive the hinge rod carried by the brackets of the container, and a plurality of embossments in said sheet extending transversely and longitudinally providing reinforcing ribs including at least one longitudinal rib spanning the sheet near the front edge thereof and a plurality of transverse ribs spanning the sheet between the longitudinal rib and the U-shaped hinge portions.

2. A lid or cover for open top containers comprising a single embossed plastics material sheet of uniform thickness having front, side and back edges, a U-shaped embossment along the back edge adapted to receive a hinge rod therethrough to connect the sheet with a container, a plurality of spaced parallel transverse embossments in said sheet extending from adjacent said U-shaped embossment into closely spaced relation with the front edge of the sheet, a longitudinal embossment extending longitudinally across the sheet closely adjacent the front edge thereof and intersecting said transverse embossments, said transverse and longitudinal embossments providing reinforcing ribs holding the sheet against distortion, and an integral dependent peripheral lip on the sheet.

3. The lid of claim 1 wherein the plastics material is a cross linked polyethylene.

4. The lid of claim 1 wherein the sheet has a thickness of from $\frac{1}{8}$ to $\frac{1}{4}$ inches and the embossments have a depth of from $\frac{1}{2}$ to 1 inch.

5. The lid of claim 1 wherein the transverse and longitudinal embossments intersect.

6. The lid of claim 5 wherein the intersections are near the front edge of the sheet rearwardly of the front ends of the transverse embossments.

7. The lid of claim 1 wherein the transverse ribs are in spaced parallel relation across the length of the sheet.

8. The lid or cover of claim 2 wherein the U-shaped embossment is segmented and each segment has apertured end walls providing bearings riding on the hinge rod.

9. The lid or cover of claim 2 wherein the embossments are positioned to accommodate mounting of the sheet with either face thereof providing the top of the cover.

10. The lid or cover of claim 2 wherein the ribs are raised from the top face of the sheet.

11. The lid or cover of claim 2 wherein the ribs are depressed from the top face of the sheet.

12. The lid or cover of claim 2 wherein the U-shaped embossment is deeper than the rib embossments.

* * * * *